US009976265B2

(12) United States Patent
Moran et al.

(10) Patent No.: US 9,976,265 B2
(45) Date of Patent: May 22, 2018

(54) TECHNOLOGIES FOR COMMUNICATING ROADWAY INFORMATION

(71) Applicant: Intel Corporation, Santa Clara, CA (US)

(72) Inventors: Michael T. Moran, Naas (IE); Charles Baron, Chandler, AZ (US)

(73) Assignee: Intel Corporation, Santa Clara, CA (US)

( * ) Notice: Subject to any disclaimer, the term of this patent is extended or adjusted under 35 U.S.C. 154(b) by 0 days. days.

(21) Appl. No.: 15/277,073

(22) Filed: Sep. 27, 2016

(65) Prior Publication Data

US 2017/0183832 A1 Jun. 29, 2017

Related U.S. Application Data

(63) Continuation of application No. 14/484,738, filed on Sep. 12, 2014, now Pat. No. 9,453,309.

(51) Int. Cl.
*G08G 1/09* (2006.01)
*E01F 9/30* (2016.01)
(Continued)

(52) U.S. Cl.
CPC ..... *E01F 9/30* (2016.02); *E01F 9/553* (2016.02); *G08G 1/0116* (2013.01); *G08G 1/0141* (2013.01); *G08G 1/096783* (2013.01)

(58) Field of Classification Search
CPC .... E01F 9/005; E01F 9/30; E01F 9/40; G08G 1/0116; G08G 1/0141; G08G 1/015; G08G 1/08
(Continued)

(56) References Cited

U.S. PATENT DOCUMENTS 2,849,701 A * 8/1958 Clark ..... G08G 1/096716 340/581
3,529,284 A 9/1970 Villemain
(Continued)

FOREIGN PATENT DOCUMENTS

JP 2003-288696 10/2003
KR 10-2011-0121189 10/2011

OTHER PUBLICATIONS

International Search Report for International Patent Application PCT/US2015/044568, dated Nov. 19, 2015, 3 pages.
(Continued)

*Primary Examiner* — Eric M Blount
(74) *Attorney, Agent, or Firm* — Barnes & Thornburg LLP

(57) ABSTRACT

Technologies for communicating roadway information includes a plurality of roadway markers configured to propagate communications amongst each other. To do so, each roadway marker is configured to transmit communications to one or more other roadway markers. The communications may include sensor data generated by a sensor of a roadway marker. One or more roadway markers may transmit the sensor data to a roadway controller. Additionally or alternatively, the communication may include an alert message. A roadway marker may include a local alert device and be configured to activate the alert device in response to receiving an alert message. Additionally, one or more roadway markers may communicate with a roadway controller, a roadway traffic device, and/or an in-vehicle computing system of a vehicle to propagate roadway marker sensor data and/or alert messages. The roadway controller may be configured to control the roadway traffic devices, roadway makers, and/or communicate with remote computing devices.

23 Claims, 8 Drawing Sheets

(51) Int. Cl.
*E01F 9/553* (2016.01)
*G08G 1/01* (2006.01)
*G08G 1/0967* (2006.01)

(58) Field of Classification Search
USPC ..... 340/905, 907, 908, 908.1
See application file for complete search history.

(56) References Cited

U.S. PATENT DOCUMENTS 4,241,326 A * 12/1980 Odom ..... G08G 1/161 340/333
4,321,589 A * 3/1982 King ..... G08G 1/087 340/384.7
4,926,163 A * 5/1990 Beebe ..... G08B 19/02 340/581
5,289,183 A * 2/1994 Hassett ..... G01S 13/765 340/905
5,673,039 A 9/1997 Pietzsch
5,760,686 A 6/1998 Toman
6,064,318 A 5/2000 Kirchner
6,107,941 A 8/2000 Jones
6,559,774 B2 5/2003 Bergan
6,602,021 B1 8/2003 Kim
6,900,740 B2 5/2005 Bloomquist
7,077,600 B1 * 7/2006 Whinery ..... E01F 9/578 404/12
7,230,546 B1 6/2007 Nelson
7,231,240 B2 6/2007 Eda et al.
7,258,507 B2 8/2007 Kim
7,273,328 B2 * 9/2007 Hunter ..... E01F 9/559 340/815.45
7,347,643 B2 3/2008 Joeng
7,382,274 B1 6/2008 Kermani
7,688,222 B2 3/2010 Peddle
7,755,510 B2 7/2010 Billimoria
7,817,064 B2 10/2010 Nishida
8,219,306 B2 7/2012 Kim
8,231,240 B1 7/2012 Rubio
8,237,555 B2 * 8/2012 McCarthy ..... G08G 1/01 340/435
8,704,676 B2 4/2014 Hawkes
8,730,059 B2 5/2014 Davis
8,840,335 B2 9/2014 Martin
9,076,339 B2 7/2015 Hawkes
9,142,130 B1 9/2015 Dukish
2002/0008973 A1 1/2002 Boys
2005/0270175 A1 12/2005 Peddle
2006/0193691 A1 8/2006 Gonzalez
2010/0207787 A1 8/2010 Catten
2011/0035140 A1 2/2011 Candy
2011/0199231 A1 8/2011 Loiselle
2012/0194353 A1 8/2012 Groves
2012/0249341 A1 10/2012 Brown et al.
2012/0290150 A1 11/2012 Doughty et al.
2013/0063282 A1 3/2013 Baldwin et al.
2013/0113618 A1 * 5/2013 Flanagan ..... G08G 1/166 340/539.1

OTHER PUBLICATIONS

Written Opinion for International Patent Application PCT/US2015/044568, dated Nov. 19, 2015, 9 pages.

* cited by examiner

TECHNOLOGIES FOR COMMUNICATING ROADWAY INFORMATION

CROSS-REFERENCE TO RELATED APPLICATIONS

This application is a continuation of U.S. application Ser. No. 14/484,738, filed Sep. 12, 2014 entitled "TECHNOLOGIES FOR COMMUNICATING ROADWAY INFORMATION".

BACKGROUND

Roadway markers, sometimes referred to as "pavement markers," "cat's eyes," "turtles," or "buttons," are safety devices used to mark roadways. Typically, such devices are embedded in or attached to the surface of the roadway to delineate the roadway for drivers. For example, roadway markers may be attached along the center divider line and/or the side of a roadway to identify a lane to a driver. Some roadway markers, such as "cat's eye" markers, are retro reflective and reflect light from a vehicle's headlights back to the driver to better identify the roadway at night. Additionally, typical roadway markers extend above the surface by some amount to provide a tactile "rumble" feedback to the driver should the driver drive over the roadway marker.

Many roadway markers are "dumb" devices, in the respect that they include no electrical components. For example, typical reflective-type roadway markers achieve their retro reflective function using reflective paint, tape, or other material. Some roadway markers, however, include lights (e.g., light emitting diodes), which are powered by a solar cell array housed in the roadway marker. Such roadway markers visually identify the roadway at night by illuminating the included lights.

BRIEF DESCRIPTION OF THE DRAWINGS

The concepts described herein are illustrated by way of example and not by way of limitation in the accompanying figures. For simplicity and clarity of illustration, elements illustrated in the figures are not necessarily drawn to scale. Where considered appropriate, reference labels have been repeated among the figures to indicate corresponding or analogous elements.

DETAILED DESCRIPTION OF THE DRAWINGS

Figure 1:
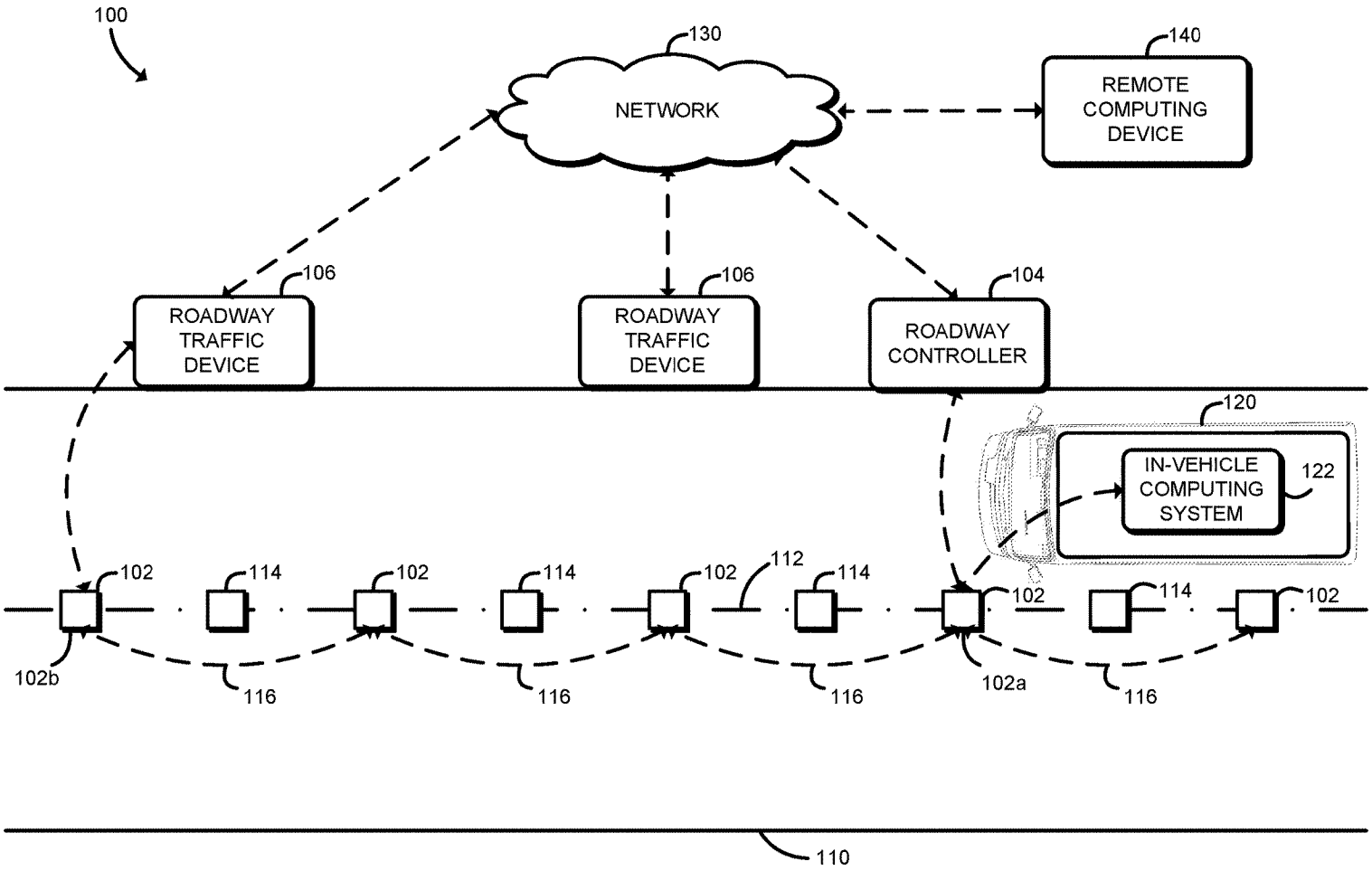
FIG. 1 is a simplified diagram of a roadway system for communicating roadway information.

While the concepts of the present disclosure are susceptible to various modifications and alternative forms, specific embodiments thereof have been shown by way of example in the drawings and will be described herein in detail. It should be understood, however, that there is no intent to limit the concepts of the present disclosure to the particular forms disclosed, but on the contrary, the intention is to cover all modifications, equivalents, and alternatives consistent with the present disclosure and the appended claims.

References in the specification to "one embodiment," "an embodiment," "an illustrative embodiment," etc., indicate that the embodiment described may include a particular feature, structure, or characteristic, but every embodiment may or may not necessarily include that particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to effect such feature, structure, or characteristic in connection with other embodiments whether or not explicitly described. Additionally, it should be appreciated that items included in a list in the form of "at least one A, B, and C" can mean (A); (B); (C): (A and B); (B and C); (A and C); or (A, B, and C). Similarly, items listed in the form of "at least one of A, B, or C" can mean (A); (B); (C): (A and B); (B and C); (A or C); or (A, B, and C).

The disclosed embodiments may be implemented, in some cases, in hardware, firmware, software, or any combination thereof. The disclosed embodiments may also be implemented as instructions carried by or stored on one or more transitory or non-transitory machine-readable (e.g., computer-readable) storage medium, which may be read and executed by one or more processors. A machine-readable storage medium may be embodied as any storage device, mechanism, or other physical structure for storing or transmitting information in a form readable by a machine (e.g., a volatile or non-volatile memory, a media disc, or other media device).

In the drawings, some structural or method features may be shown in specific arrangements and/or orderings. However, it should be appreciated that such specific arrangements and/or orderings may not be required. Rather, in some embodiments, such features may be arranged in a different manner and/or order than shown in the illustrative figures. Additionally, the inclusion of a structural or method feature in a particular figure is not meant to imply that such feature is required in all embodiments and, in some embodiments, may not be included or may be combined with other features.

Referring now to FIG. 1, an illustrative roadway system 100 includes multiple roadway markers 102 attached to a roadway 110, a roadway controller 104, and one or more roadway traffic devices 106. The roadway markers 102 may be attached to the roadway 110 at any location useful in delineating or identifying the roadway 110 or a lane thereof.

For example, in the illustrative embodiment of FIG. 1, the roadway markers 102 are attached to the roadway 110 along a center divider line 112, which may be defined by payment paint, stickers, or the like. Of course, the roadway markers 102 may be attached to the roadway 110 in other locations, such as a shoulder of the roadway 110 in addition to or instead of the center divider line 112. As discussed in more detail below, the roadway markers 102 are embodied as "smart" roadway markers and include electrical components to facilitate communication between each other. As such, the roadway markers 102 may be attached to the roadway 110 a distance apart from each other based on the capable range of communications between each other. One or more "dumb" roadway markers 114 may be attached to the roadway 110 between each respective pair of roadway markers 102. The roadway markers 114 may be embodied as typical roadway markers and may be embodied as retro reflective markers, include lights powered by a solar panel array, or the like. Depending on the particular implementation, the amount of inter-marker communication, local environmental conditions, and/or other factors, a given stretch of roadway 110 may include a greater or fewer number of roadway markers 102.

In use, the roadway markers 102 are configured to propagate communications amongst each other, as well as the roadway controller 104 and/or an in-vehicle computing system 122 of a vehicle 120 traveling along the roadway 110 as discussed in more detail below. For example, as shown in FIG. 1, each roadway marker 102 may propagate a communication 116 by receiving the communication 116 from a nearby roadway marker 102 and transmitting the communication 116 to another nearby roadway marker 102. In this way, the communication 116 may be transmitted along a stretch of roadway 110 via a sequence of roadway markers 102.

Some roadway markers 102 may be configured to communicate only with other roadway markers 102 to propagate the inter-marker communication. Other roadway markers 102, such as the roadway marker 102*a*, are configured to also communicate with the roadway controller 104 and/or the in-vehicle computing system 122 of the vehicle 120 to pass along the communications received from the other roadway markers 102. The communications propagated by the roadway markers 102 may be embodied as sensor data generated by sensors of one or more roadway markers 102, alert messages that cause the roadway markers 102 to perform an alert function (e.g., illuminate, flash a light, change color of a light, etc.), and/or alert messages designated for the roadway controller 106 and/or the in-vehicle computing system 122 (e.g., an alert message informing the driver of the vehicle 120 that a crash has occurred ahead on the roadway 110). The alert messages may be generated by the roadway controller 104 based on the roadway marker sensor data or generated by one or more roadway markers 102. For example, some roadway markers 102 may include additional processing functionality to process sensor data and generate an alert message based on such analysis.

As discussed above, the roadway controller 104 receives communications from one or more roadway markers 102 (e.g., roadway marker 102*a* of FIG. 1). The roadway controller 104 may process the received communications and control one or more roadway traffic devices 106 based on such analysis. The roadway traffic devices 106 may be embodied as any type of device for facilitating roadway traffic including, but not limited to, roadway lights such as lamp posts, traffic lights, roadway alert devices (e.g., sirens), and/or roadway signs such as emergency signs. For example, the roadway controller 104 may receive sensor data generated by a roadway marker 102 and indicative of a presence of the vehicle 120 on the roadway 110, process the sensor data, and transmit a control message to a roadway light located ahead of the vehicle to switch the light from an off-state to an on-state to illuminate the roadway 110 ahead of the vehicle 120. In some embodiments, one or more of the roadway markers 102 (e.g., roadway marker 102*b* of FIG. 1) may be configured to directly communicate with a roadway traffic device 106 to control the functionally of the roadway traffic device 106 as discussed in more detail below.

The roadway controller 104 may transmit the control messages to the roadway traffic devices 106 over a network 130 as shown in FIG. 1. Additionally, the roadway controller 104 may provide notifications and/or other data (e.g., the roadway marker sensor data) to one or more remote computing devices 140 over the network 130. The remote computing device 140 may be embodied as any type of computing device capable of receiving such communications including, but not limited to, a smart phone, a tablet computer, a laptop computer, a desktop computer, a server, a networked appliance, an in-vehicle computing system, or other computing device or system capable of receiving communications from the roadway controller 104 over the network 130.

The network 130 may be embodied as any type of communication network capable of facilitating communication between the roadway controller 104 and other computing devices of the roadway system 100. As such, the network 108 may include one or more networks, routers, switches, computers, and/or other intervening devices. For example, the network 108 may be embodied as or otherwise include one or more local or wide area networks, cellular networks, publicly available global networks (e.g., the Internet), an ad hoc network, a short-range communication network or link, or any combination thereof.

Although the illustrative roadway system 100 of FIG. 1 includes a single roadway controller 104, two roadway traffic devices 106, a single in-vehicle computing system 122, a single remote computing device 140, it should be appreciated that the roadway system 100 may include many roadway controllers 104, roadway traffic devices 106, in-vehicle computing systems 122, and/or remote computing devices 140 in other embodiments. For example, a roadway controller 104 may be located periodically along the roadway 110 to receive communications from the roadway markers 102. Additionally, any number of roadway traffic devices 106 may be established along a stretch of the roadway 110 depending on the type of roadway, location of the roadway, local roadway conditions, and so forth. Further, any number of computing devices 140 may communicate with one or more roadway controllers 104 to receive the sensor data and/or notifications therefrom.

Figure 2:
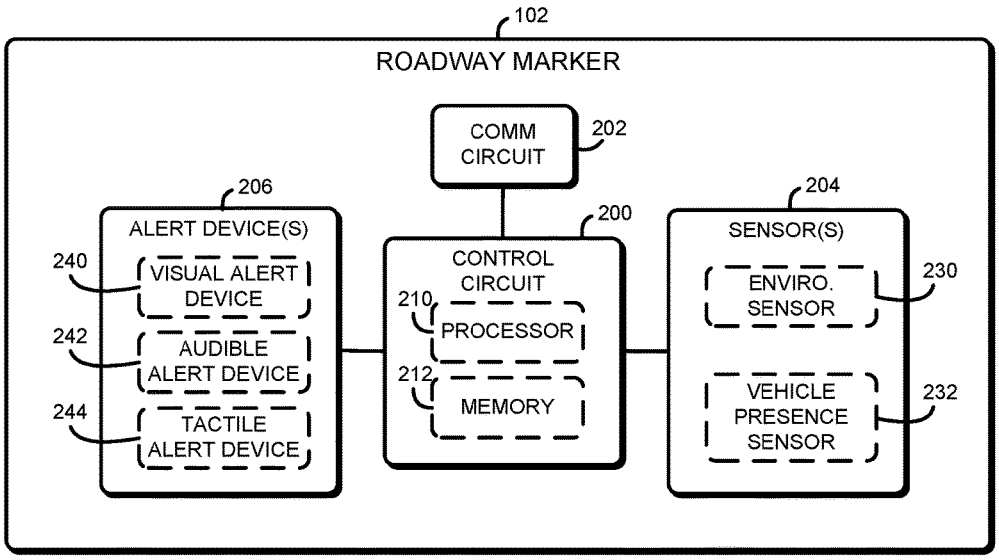
FIG. 2 is a simplified block diagram of at least one embodiment of a roadway marker of the roadway system of FIG. 1.

Referring now to FIG. 2, in the illustrative embodiment, each roadway marker 102 may include a control circuit 200, a communication circuit 202, one or more sensors 204, and one or more alert devices 206. Of course, in other embodiments, the roadway markers 102 may include additional components or features, such as those features commonly found in a typical roadway marker (e.g., retro reflective features). Additionally, in some embodiments, one or more of the illustrative components of the roadway marker 102 may form a portion of a system-on-a-chip (SoC). For example the control circuit 200 and the communication circuit 202, along with other components of the roadway marker 102, may be incorporated together on a single integrated circuit chip.

The control circuit 200 may be embodied as any type of control circuit capable of controlling operation of the roadway marker 102. In some roadway markers 102, the control circuit 200 is embodied as a low-featured control circuit, such as a low-featured micro-controller or other control circuit or device. In such embodiments, the roadway marker 102 may be configured to simply propagate communications received from other roadway markers. In other roadway markers 102, the control circuit 200 may be embodied as full-featured or higher-featured control circuit. For example, in some embodiments, the control circuit 200 may include a processor 210, a memory 212, and/or other components commonly found in a control circuit (e.g., an input/output subsystem, peripheral devices, etc.).

The processor 210 may be embodied as any type of processor capable of performing the functions described herein. For example, the processor 210 may be embodied as a single or multi-core processor(s), a digital signal processor, a microcontroller, or other processor or processing/controlling circuit. Similarly, the memory 212 may be embodied as any type of volatile or non-volatile memory or data storage capable of performing the functions described herein. In operation, the memory 212 may store various data and software used during operation of the roadway marker 102 such as control software, sensor data, messages, and/or other software or data.

The communication circuit 202 of the roadway marker 102 may be embodied as any communication circuit, device, or collection thereof, capable of enabling communications between the roadway marker 102 and other roadway markers 102, roadway controllers 104, in-vehicle computing systems 122, and/or roadway traffic devices 106. To do so, the communication circuit 202 may be configured to use any one or more communication technology (e.g., wireless or wired communications) and associated protocols (e.g., Bluetooth®, Zigbee®, Ethernet, Wi-Fi®, WiMAX, etc.) to effect such communication. For example, in some embodiments, the roadway markers 102 are configured to propagate communications between each other by wirelessly transmitting the communications (e.g., as shown as communication 116 of FIG. 1). In other embodiments, the roadway markers 102 may be communicatively wired to each other via a wired connection embedded in the roadway 110 and utilize such wired connection for wired communication therebetween.

Each sensor 204 may be embodied as any type of sensor capable of generating sensor data indicative of a road condition in the vicinity of the sensor 204. In some embodiments, one or more sensors 204 may be embodied as an environment sensor 230 configured to sense environmental conditions local to the roadway marker 102 and generate sensor data indicative of such conditions. For example, the environment sensor 230 may be configured to sense the level of light (e.g., daytime or nighttime), fog conditions, precipitation conditions, freezing conditions, or other environmental conditions and generate sensor data indicative of such environmental conditions.

Additionally or alternatively, one or more sensors 204 may be embodied as a vehicle presence sensor 232 configured to sense the presence of a vehicle 120 on the roadway 110 in the vicinity of the roadway marker 102. To do so, the vehicle presence sensor 232 may utilize any suitable technology to sense the presence of the vehicle 120. For example, the vehicle presence sensor 232 may be embodied as a motion sensor configured to detect motion of the vehicle 120, an optical sensor configured to detect headlights or other light sources of the vehicle 120, an inductance or capacitance sensor configured to detect the presence of the vehicle 120 based on a change in inductance or capacitance caused by the presence of the vehicle 120, or any other sensor capable of generating data indicative of the presence of the vehicle 120 or from which the presence of the vehicle 120 may be determined. For example, in some embodiments, the vehicle presence sensor 232 may be embodied as, or otherwise include, a communication circuit (e.g., communication circuit 202) configured to communicate with the in-vehicle computing system 122 of the vehicle 120 to determine the presence of the vehicle.

Each alert device 206 may be embodied as any controllable device capable of generating a notification or alert to a driver of the vehicle 120. For example, in some embodiments, one or more of the alert devices 206 may be embodied as a visual alert device 240. The visual alert device 240 may be embodied as any alert device capable of providing a visual alert to the driver. For example, the visual alert device 240 may be embodied as one or more controllable lights including, but not limited to light emitting diodes or displays. The operation of such lights may be controlled to adjust, for example, the illumination intensity, blinking periodicity, the color, and/or other feature of visual alert device 240. Additionally, in some embodiments, one or more of the alert devices 206 may be embodied as an audible alert device 242. The audible alert device 242 may be embodied as any alert device capable of providing an audible alert to a driver including, but not limited to, a speaker, horn, siren, or other audio generating device. Further, in some embodiments, one or more of the alert devices 206 may be embodied as a tactile alert device 244. The tactile alert device 244 may be embodied as any alert device capable of providing a tactile alert to a driver. For example, the tactile alert device 244 may cause the roadway marker 102 to rumble, which may be felt by the driver of vehicle 120 traveling over the roadway marker 102 or in close proximity to the roadway marker 102.

Depending on the desired functionally of the roadway marker 102, each roadway marker 102 may include a different set of the components described above in regard to FIG. 2. For example, some roadway markers 102 may be configured to simply propagate communications received from other roadway markers 102. Such roadway markers may include only the control circuit 200, which may be embodied as a low-featured micro-controller, and the communication circuit 202. Other roadway markers 102 may be embodied as full-featured or high-featured devices and include one or more sensors 204 and/or one or more alert devices 206. Additionally, as discussed above, some roadway markers 102 may include local processing capabilities (e.g., processor 210 and memory 212) to locally process sensor data generated by sensors 204 of the particular roadway marker 102 or received from other roadway markers 102. In this way, roadway markers 102 of varying capabilities, and associated costs, may be used in the roadway system 100.

Figure 3:
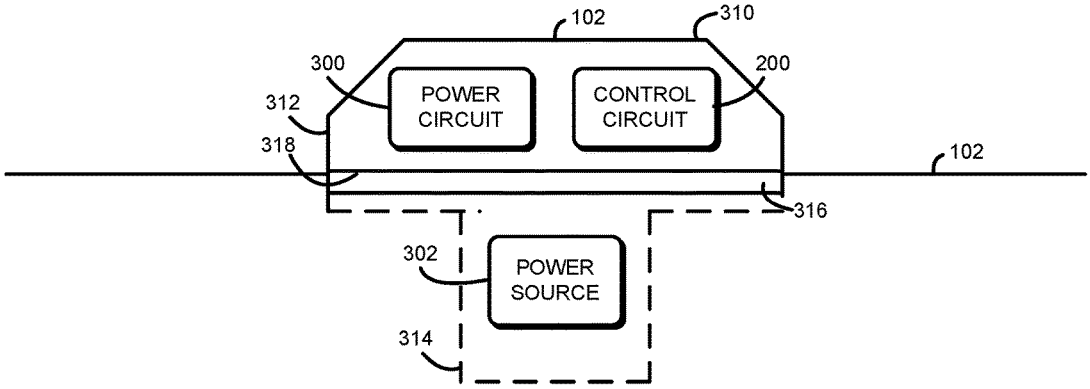
FIG. 3 is a simplified side elevation view of at least one embodiment of the roadway marker of FIG. 2 embedded in a roadway.

Referring now to FIG. 3, each roadway marker 102 also includes a power circuit 300 configured to provide power to other components (e.g., the control circuit 200) of the roadway marker 102. The power circuit 300 may be embodied as any type of power circuit capable of providing power to the roadway marker 102. For example, the power circuit 300 may be embodied as a solar cell array to generate power based on an amount of sun light received by the array. Additionally or alternatively, in embodiments in which the roadway markers 102 are wired to each other, the power circuit 300 may be configured to regulate a power provided by a power line connected to each roadway marker 102. In some embodiments, each roadway marker 102 may also include a rechargeable power source 302. In such embodiments, the power circuit 300 is configured to supply power to the rechargeable power source 302, which provides power to the other components of the roadway marker 102. The rechargeable power source 302 may be embodied as any type of rechargeable power source such as a rechargeable battery, capacitor bank, or the like.

In some embodiments, the power circuit 300 may be embodied as a thermoelectric power circuit configured to generate power based on difference in temperature experience by different sections of the roadway marker 102. For example, the roadway marker 102 may include a housing 310 having an upper enclosure 312 and a bottom enclosure 314, which extends downwardly from the upper enclosure 312. When the illustrative roadway marker 102 is attached to the roadway 110, the upper enclosure 312 rests on top of an upper surface of the roadway 110 and is exposed to the open environment, while the bottom enclosure 314 is embedded into the roadway 110. As such, a thermoelectric power circuit 300 may generate power based on the difference in temperature experience by the upper enclosure 312 (air temperature) and the bottom enclosure 314 (ground temperature). To better accentuate the temperature difference between the upper enclosure 312 and lower enclosure 314, the roadway marker 102 may include an insulation layer 316 attached to a bottom surface 318 of the upper enclosure 312 to insulate the upper enclosure 312 from the ground temperature. The insulation layer 316 may be embodied as any material capable of providing an amount of thermal insulation.

Of course, in other embodiments, the power circuit 300 may be embodied as, or otherwise include, other types of power circuits. For example, in some embodiments, the power circuit 300 may in addition or alternatively be configured to facilitate charging of the rechargeable power source 302 via induction. Additionally, in other embodiments, the power circuit 300 may in addition or alternatively be embodied as a piezo-type power circuit configured to charge the rechargeable power source 302 in response to receiving impacts. As such, as vehicles drive over the roadway marker 102, the power circuit 300 recharges the rechargeable power source 302 in response to the resulting impacts.

Figure 4:
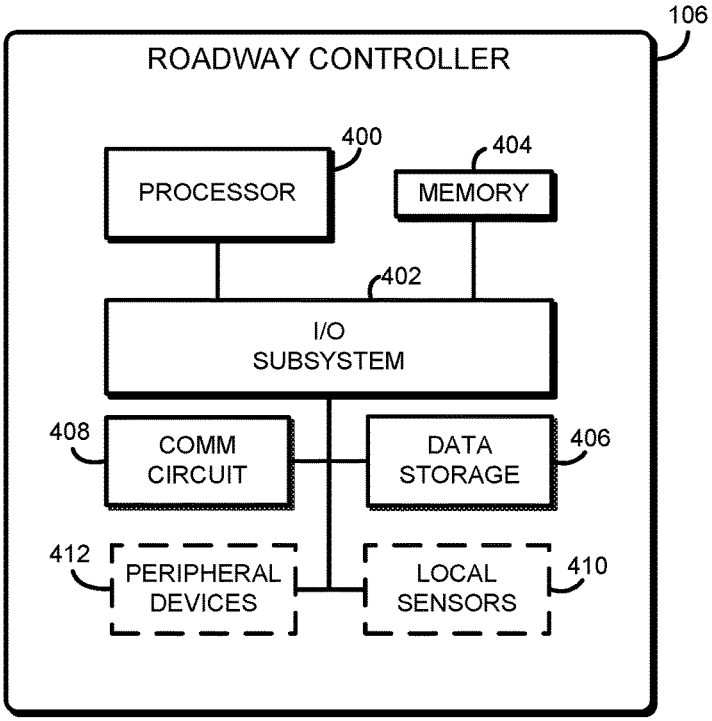
FIG. 4 is a simplified block diagram of at least one embodiment of a roadway controller of the roadway system of FIG. 1.

Referring now to FIG. 4, the roadway controller 104 may be embodied as any type of computing device capable of performing the function described herein. For example, the roadway controller 104 may be embodied as a special-purpose computer system, a server computing device, distributed computing system, a multiprocessor system, a workstation, a smart appliance, a desktop computer, a laptop computer, a table computer, a smartphone, and/or any other computing device capable of capable of communicating with the roadway markers 102 and controlling a roadway 110 based such communications. As shown in FIG. 1, the illustrative roadway controller 104 includes a processor 400, an I/O subsystem 402, memory 404, a data storage device 406, and communication circuit 408. Of course, the roadway controller 104 may include other or additional components, such as those commonly found in a server computer (e.g., various input/output devices), in other embodiments. Additionally, in some embodiments, one or more of the illustrative components may be incorporated in, or otherwise form a portion of, another component. For example, the memory 404, or portions thereof, may be incorporated in the processor 400 in some embodiments.

The processor 400 may be embodied as any type of processor capable of performing the functions described herein. For example, the processor may be embodied as a single or multi-core processor(s), digital signal processor, microcontroller, or other processor or processing/controlling circuit. Similarly, the memory 404 may be embodied as any type of volatile or non-volatile memory or data storage capable of performing the functions described herein. In operation, the memory 404 may store various data and software used during operation of the roadway controller 104 such as operating systems, applications, programs, libraries, and drivers. The memory 404 is communicatively coupled to the processor 400 via the I/O subsystem 402, which may be embodied as circuitry and/or components to facilitate input/output operations with the processor 400, the memory 404, and other components of the roadway controller 104. For example, the I/O subsystem 402 may be embodied as, or otherwise include, memory controller hubs, input/output control hubs, firmware devices, communication links (i.e., point-to-point links, bus links, wires, cables, light guides, printed circuit board traces, etc.) and/or other components and subsystems to facilitate the input/output operations. In some embodiments, the I/O subsystem 402 may form a portion of a system-on-a-chip (SoC) and be incorporated, along with the processor 400, the memory 404, and other components of the roadway controller 104, on a single integrated circuit chip.

The data storage device 406 may be embodied as any type of device or devices configured for short-term or long-term storage of data such as, for example, memory devices and circuits, memory cards, hard disk drives, solid-state drives, or other data storage devices. The data storage device 406 may store sensor data received from one or more roadway markers 102.

The communication circuit 408 may be embodied as any communication circuit, device, or collection thereof, capable of enabling communications between the roadway controller 104 and the roadway markers 102, the roadway traffic devices 106, the in-vehicle computing system 122, and/or the remote computing devices 140. The communication circuitry 408 may be configured to use any one or more communication technology (e.g., wireless or wired communications) and associated protocols (e.g., Bluetooth®, Zigbee®, Ethernet, Wi-Fi®, WiMAX) to effect such communication.

In some embodiments, the roadway controller 104 may also one or more local sensors 410 and/or one or more peripheral devices 412. The local sensors 410 may be similar to the sensors 204 of the roadway marker 102 and may be embodied as any type of sensor capable of generating sensor data indicative of a condition of the roadway 110. For example, the local sensors 204 may be embodied as, or otherwise include, environment sensors and/or vehicle presence sensors. The peripheral devices 412 may include any number of additional input/output devices, interface devices, and/or other peripheral devices. For example, the peripheral devices 412 may include typical input/output devices such as a display, keyboard, and/or touchscreen, or other peripheral devices.

Figure 5:
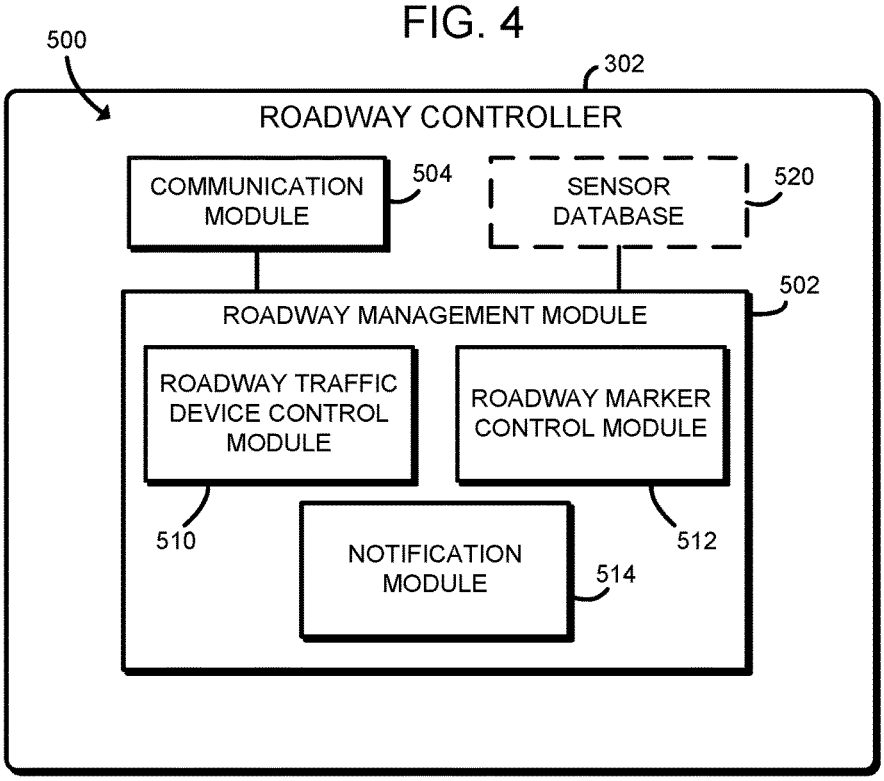
FIG. 5 is a simplified block diagram of at least one embodiment of an environment of the roadway controller of FIG. 4.

Referring now to FIG. 5, in the illustrative embodiment, the roadway controller 104 establishes an environment 500 during operation. The illustrative environment 500 includes a roadway management module 502 and a communication module 504. The roadway management module 502 includes roadway traffic device control module 510, a roadway marker control module 512, and a notification module 514. Additionally, the environment 500 may include a sensor database 520 in some embodiments. The various modules of the environment 500 may be embodied as hardware, firmware, software, or a combination thereof. For example, each of the modules, logic, and other components of the environment 500 may form a portion of, or otherwise be established by, the processor 400 or other hardware components of the roadway controller 104.

The roadway management module 502 is configured to receive communications from one or more roadway markers 102 via the communication module 504, analyze the received communications, and control the roadway traffic devices 106 and/or the roadway markers 102 based on the analysis of the received communications. Additionally, the roadway management module 502 may provide notifications and/or other information or data to the remote computing devices 140. As discussed above, the communications received from the roadway markers 102 may be embodied as sensor data generated by one or more roadway markers 102 and/or alert messages generated by one or more roadway markers 102 or other computing device in communication with a roadway marker 102. The roadway management module 502 may analyze the sensor data by aggregating received sensor data over a particular time period and/or with other history sensor data, which may be stored in the sensor database 520 over time.

The roadway traffic device control module 510 is configured to monitor received sensor data or alert messages and control one or more traffic devices 106 based on the received sensor data or alert messages. To do so, the roadway traffic device control module 510 may generate a control message based on the sensor data or alert message and transmit the control message to one or more roadway traffic devices 106 via the network 130 to the operation of the roadway traffic device 106. That is, the operation or functionality of the roadway traffic device 106 may be determined based on the received control message. For example, the roadway traffic device control module 510 may receive sensor data from a roadway marker 102 indicative of a fog condition and, in response to analysis of the sensor data, generate and transmit a control message to a roadway light to cause the roadway light to turn on or increase its illumination.

The roadway marker control module 512 is configured to monitor received sensor data and control one or more roadway markers 102 based on the received sensor data. To do so, the roadway marker control module 512 may generate an alert message based on the received sensor data and transmit the alert message to a roadway marker 102. The alert message may, for example, cause the roadway marker 102 to perform an alert function (e.g., active an alert device). As discussed above, the roadway marker 102 may propagate the alert message received from the roadway marker control module 512 to other roadway markers 102 to cause multiple roadway markers to perform the alert function defined by the alert message (e.g., to cause a row of roadway markers 102 to blink their respective visual alert devices).

The notification module 514 is configured to monitor for requests for information received from the remote computing device 140 and respond to such requests. For example, the notification module 514 may generate notification messages based on received sensor data (e.g., a notification of freezing conditions) and transmit the notification messages to the remote computing device 140. In some embodiments, the notification module 514 may push such notifications to the remote computing devices 140, in addition or alternatively to responding to requests. Additionally, the notification module 514 may communicate raw sensor data received by from one or more marker sensors 204 to the remote computing devices 140.

Figure 6:
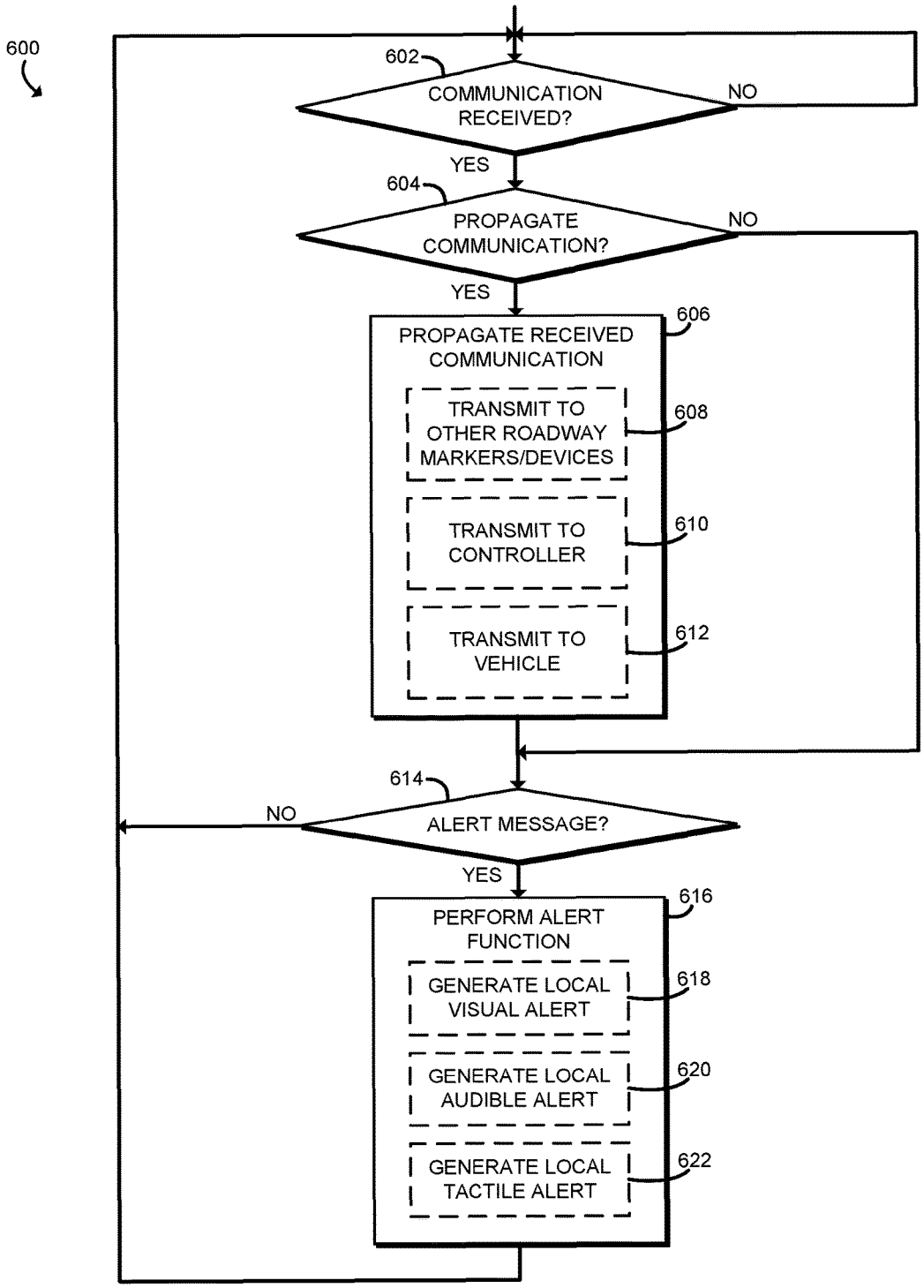
FIG. 6 is a simplified flow diagram of at least one embodiment of a method for propagating communication that may be executed by the roadway marker of FIGS. 2 and 3.

Referring now to FIG. 6, as discussed above, the roadway markers 102 are configured to communicate with each other and/or other devices. To do so, the roadway markers 102 may execute a method 600 for propagating communications. The method 600 begins with block 602 in which the roadway marker 102 determines whether a communication has been received. The communication may be embodied as sensor data, an alert message, or other message or information. Additionally, the communication may be received from another roadway marker 102, a roadway controller 104, a roadway traffic device 106, and/or an in-vehicle computing system 122 of a vehicle 120 traveling on the roadway 110. If no communication is received, the method 600 loops back to block 602 to continue monitoring for incoming communications.

If, however, a communication is received in block 602, the method 600 advances to block 604 in which the roadway marker 102 determines whether to propagate the communication. Such determination may be based on the particular type of communication and/or of the factors (e.g., based on real-time sensor data of sensors 204 of the present roadway marker 102). If the roadway marker 102 determines that the communication should be propagated, the method 600 advances to block 606 in which the roadway marker propagates the received communication. For example, in block 608, the roadway marker 102 may propagate the communication to other roadway markers by transmitting the communication to the next roadway marker 102 in the sequence of roadway markers. Such transmissions may be embodied as directed transmissions to the next roadway marker 102 or as broadcast transmission based on the communication protocols used and the particular implementation. Additionally or alternatively, the roadway marker 102 may be configured to transmit the communication to a nearby roadway controller 104 in block 610. As discussed above, some roadway markers 102 may be configured to communicate with the roadway controller 104 directly, while other roadway markers 102 communicate indirectly via other roadway markers 102. Similarly, some roadway markers 102 may also be configured to transmit the communication to an in-vehicle computing system 122 of a vehicle 120 traveling on the roadway 110. To do so, the roadway marker 102 may establish (e.g., via a suitable handshake) a communication link with the in-vehicle computing system 122, which is transferred to other roadway markers 102 similar to transfer of cellular communication amongst cellular towers. Alternatively, the roadway markers 102 may be configured broadcast the communications, which may be received by the in-vehicle computing system 122 (and other computing devices local to the roadway marker 102).

If the roadway marker 102 determines not to propagate the communication or after the communication has been propagated, the method 600 advances to block 614 in which the roadway marker 102 determines whether the received communication is an alert message. As discussed above, an alert message may be generated by a roadway marker 102 or the roadway controller 104. If the communication is not an alert message, the method 600 loops back to block 602 to continue monitoring for received communications.

If, however, the received communication is an alert message, the method 600 advances to block 616 in which the roadway marker 102 performs an alert function. The particular alert function performed by the roadway marker 102, and the operation of the alert function, may be dictated by the alert message itself or may be predefined by the components of the roadway marker 102. For example, the roadway marker 102 may generate a local visual alert in block 618 by activating a visual alert device 240 of the alert devices 206 of the roadway marker 102. For example, the roadway marker 102 may illuminate a light, LED, display, or other visual alert device 240. As discussed above, the operation of the visual alert device 240 (e.g., illumination intensity, blinking rate, color, etc.) may also be dictated by the alert message.

Additionally or alternatively, the roadway marker 102 may generate a local audible alert in block 620 by activating an audible alert device 242 of the alert devices 206 of the roadway marker 102. For example, the roadway marker 102 may activate a siren, horn, loudspeaker, or other audible alert device 242. Again, as discussed above, the operation of the audible alert device 242 (e.g., level of annunciation, type of audible alert generated, frequency of the audible alert, etc.) may also be dictated by the alert message.

Additionally or alternatively, the roadway marker 102 may generate a local tactile alert in block 622 by activating a tactile alert device 244 of the alert devices 206 of the roadway marker 102. For example, the roadway marker 102 may activate a shaker motor or other "rumble" device. Again, as discussed above, the operation of the tactile alert device 244 (e.g., the level of "rumble," the frequency of the "rumble," etc.) also be dictated by the alert message. Regardless, after the roadway marker 102 performs the alert function in block 616, the method 600 loops back to block 602 to continue monitoring for received communications.

Figure 7:
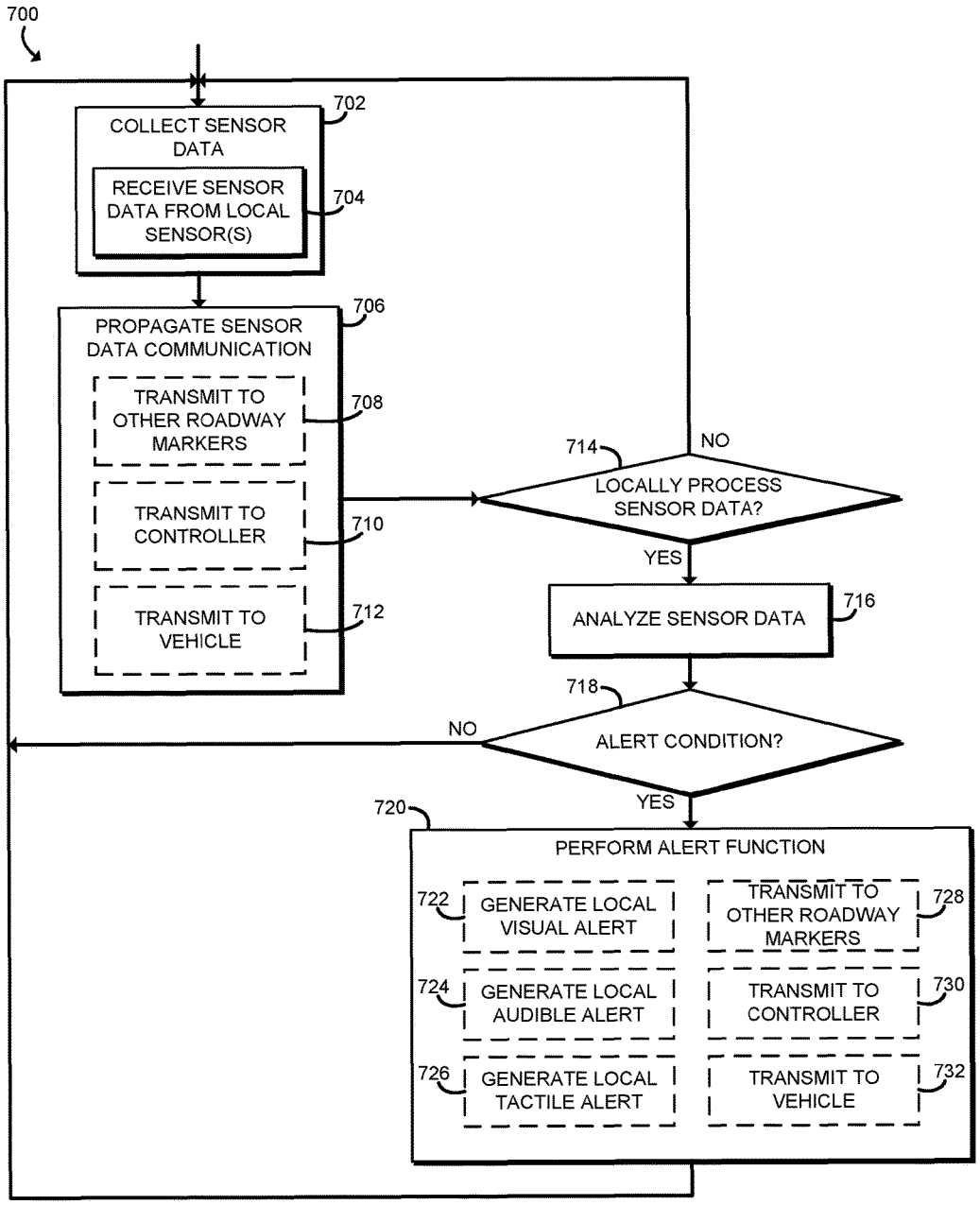
FIG. 7 is a simplified flow diagram of at least one embodiment of a method for managing local sensor data that may be executed by the roadway marker of FIGS. 2 and 3.

Referring now to FIG. 7, as discussed above, some roadway marker 102 may include local sensors 204 and/or be configured to locally process sensor data. To do so, such roadway markers 102 may also execute a method 700 for managing local sensor data. The method 700 begins with block 702 in which the roadway marker 102 collects sensor data. For example, the roadway marker 102 may receive sensor data from one or more local sensors 204 in block 704. Additionally, in block 704, the roadway marker 102 may receive other sensor data generated by other roadway markers 102. As discussed above, the sensor data may be embodied as any type of sensor data indicative of a condition of the roadway 110. For example, the sensor data may be indicative of an environmental condition of the roadway 110 (e.g., rainy conditions, freezing conditions, fog conditions, etc.), a presence of a vehicle 120 on the roadway 110, and/or the occurrence of some roadway event (e.g., a vehicular crash, drifting of a vehicle from a lane, etc.).

In block 706, the roadway marker 102 propagates the sensor data generated by the local sensors 204. To do so, as discussed above, the roadway marker 102 may transmit the sensor data to other roadway markers 102 in block 708, to a remote roadway controller in block 710, and/or to an in-vehicle computing system 122 of a vehicle traveling on the roadway 110 in block 712. After or during the propagation of the sensor data in block 706, the roadway marker 102 determines whether the generated and/or received sensor data should be locally processed. As discussed above, some roadway markers 102 may include local processing components (e.g., processor 210 and memory 212). If the roadway marker 102 does not include local processing capabilities or if the roadway marker 102 otherwise determines that the sensor data should not be locally processed, the method 700 loops back to block 702 to collect additional sensor data.

If, however, the roadway marker 102 determines that the sensor data should be processed, the method 700 advances to block 716 in which the roadway marker 102 analyzed the sensor data. The roadway marker 102 may utilize any algorithm or technique to analyze the sensor data in block 716. Additionally, as discussed above, the roadway marker 102 may store historical sensor data and utilize the historical sensor data, along with any real-time sensor data, in the analysis of block 716. Subsequently, in block 718, the roadway marker 102 determines whether an alert condition is present. The alert condition may be defined as any defined roadway condition or event. For example, the alert condition may be defined as a particular environmental condition (e.g., foggy or freezing conditions) or a roadway event (e.g., vehicular crash or lane drift). If the roadway marker 120 determines that no alert condition is present, the method 700 loops back to block 702 to collect additional sensor data.

If, however, the roadway marker 102 determines that an alert condition is present, the method 700 advances to block 720 in which the roadway marker performs an alert function. Again, as discussed above, the particular alert function, and the operation of such alert function, may be dictated by the alert condition determined in block 718. That is, different alert conditions may prompt different alert functions.

The roadway marker 102 may perform any suitable alert function in block 720. For example, in some embodiments, the roadway marker 102 may generate local alerts. In block 722, for example, the roadway marker 102 may generate a local visual alert as discussed above in regard to block 618 of the method 600. Additionally or alternatively, in block 724, the roadway marker 102 may generate a local audible alert as discussed above in regard to block 620 of the method 600. Additionally or alternatively, in block 726, the roadway marker 102 may generate a local visual alert as discussed above in regard to block 622 of the method 600.

The roadway marker may also generate alert messages in response to the alert condition and transmit the alert messages to other devices. For example, in block 728, the roadway marker 102 may transmit an alert message to other roadway markers as discussed above in regard to block 608 of the method 600. Additionally or alternatively, in block 730, the roadway marker 102 may transmit an alert message to a roadway controller 104 as discussed above in regard to block 610 of the method 600. Additionally or alternatively, in block 732, the roadway marker 102 may transmit an alert message to an in-vehicle computing system 122 of a vehicle 120 traveling on the roadway 110 as discussed above in regard to block 612 of the method 600. Regardless, after the roadway marker 102 have performed the alert function(s) in block 720, the method 700 loops back to block 702 to collect additional sensor data.

Figure 8:
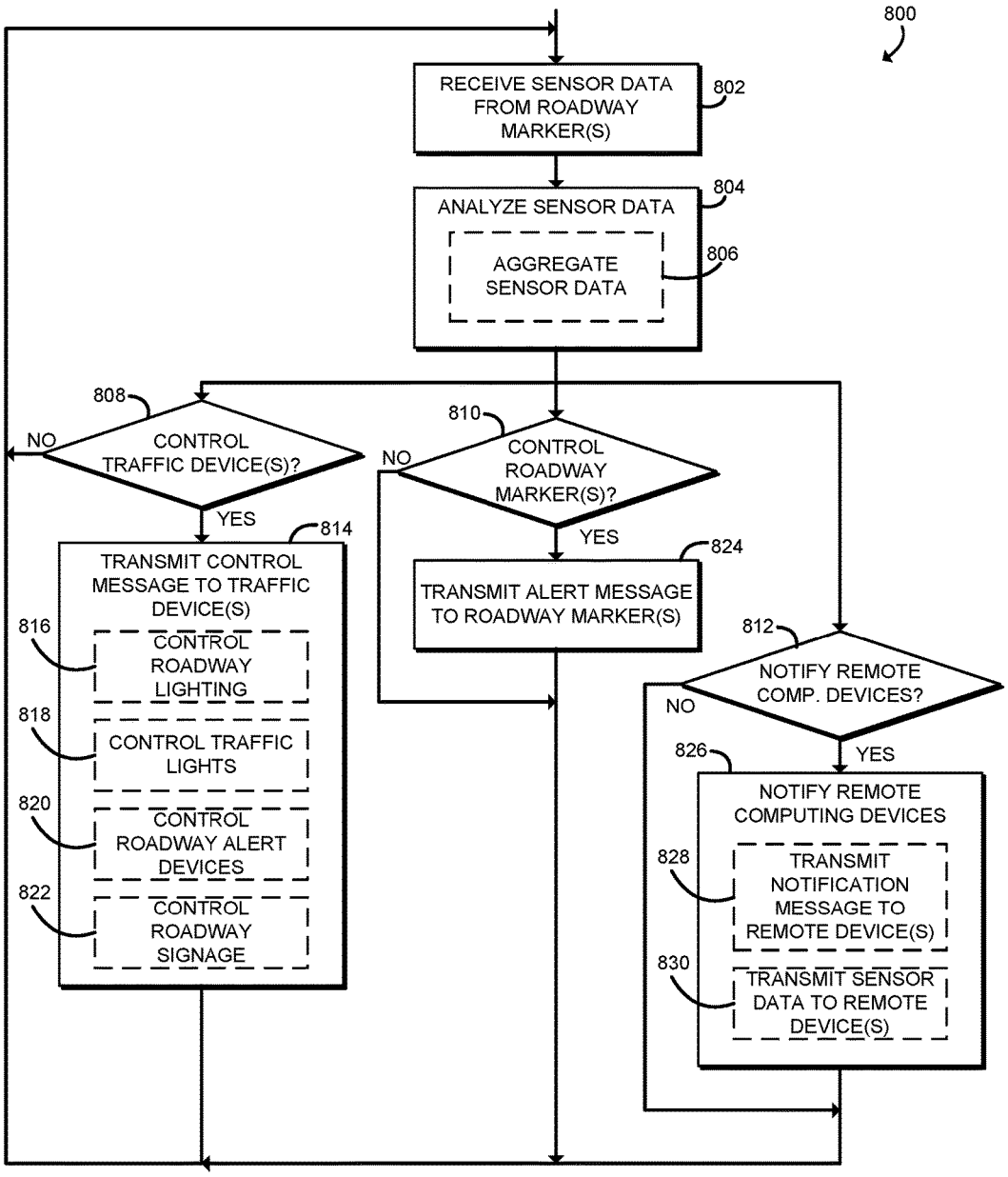
FIG. 8 is a simplified flow diagram of at least one embodiment of a method for controlling a roadway that may be executed by the roadway controller of FIGS. 4 and 5.

Referring now to FIG. 8, in use, each roadway controller 104 may execute a method 800 for controlling a roadway. The method 800 begins with block 802 in which the roadway controller 104 receive sensor data from one or more roadway markers 102. As discussed above, the sensor data may be indicative of a condition of the roadway 110 (e.g., an environmental condition, a vehicle presence, or roadway event such as a collision). Each roadway controller 104 may be in communication with a single roadway marker 102 or multiple roadway markers 102 and may receive wired or wireless communications therefrom. In addition to sensor data, the roadway controller 104 may receive other information, such as alert messages, from roadway markers 102 in block 802.

In block 804, the roadway controller 104 analyzes the sensor data (and/or alert messages). Similar to the roadway markers 102, the roadway controller 104 may utilize any algorithm or technique to analyze the sensor data in block 804. In some embodiments, the roadway controller 104 may be configured to aggregate sensor data in block 806. For example, the roadway controller 104 may aggregate sensor data received from multiple roadway markers 102, aggregate sensor data received over time, and/or aggregate real-time sensor data with historical sensor data stored in the sensor database 520 as discussed above in regard to FIG. 5. It should be appreciate that the sensor data analysis performed in block 804 may occur repeatedly and/or during execution of other blocks of the method 800.

After the roadway controller 104 has analyzed the sensor data in block 804, the method 800 advances to block 808, 810, and 812, which may be executed contemporaneously with each other. In block 808, the roadway controller 104 determines whether to control one or more roadway traffic devices 106 based on the sensor data analysis of block 804. If not, the method 800 loops back to block 802 in which the roadway controller 104 receives additional sensor data.

If, however, the roadway controller 104 determines that one or more roadway traffic devices 106 should be controlled, the method 800 advances to block 814. In block 814, the roadway controller 104 generates a control message and transmits the control message to one or more roadway traffic devices 106 to control the operation of the roadway traffic devices 106. For example, in block 816, the roadway controller 104 may transmit a control message to one or more roadway lights established along the roadway 110. The particular operation of the roadway lights (e.g., brightness, length of illumination, color, blinking rate, etc.) may be further defined by the control message. Additionally, the roadway controller 104 may adjust the control or the roadway lighting over time based on the analyzed sensor data. For example, in an illustrative embodiment, the roadway controller 104 may receive sensor data from a roadway marker 102 indicating the presence of a vehicle in the vicinity of the roadway marker 102. In response, the roadway controller 104 may identify a roadway light located in front of the vehicle 120 and another roadway light located behind the vehicle 120. The roadway controller 104 may transmit a control message to the roadway light located in front of the vehicle 120 to cause the roadway light to switch from an off-state to an on-state and transmit another control message to the roadway light located behind the vehicle 120 to switch the roadway light from an on-state to an off-state. In this way, the roadway controller 104 may progressively illuminate the roadway 110 based on the location and direction of travel of the vehicle 120, while turning off unneeded roadway lights to converse energy.

Additionally or alternatively, in block 818, the roadway controller 104 may control traffic lights of the roadway 110 based on the analyzed sensor data. For example, if the roadway controller 104 determines that a vehicle collision has occurred based on the received sensor data, the roadway controller 104 may transmit a control message to control one or more traffic lights to establish an emergency corridor for emergency vehicles, stop traffic from progressing toward the collision site, and so forth.

Additionally or alternatively, in block 820, the roadway controller 104 may control roadway alert devices based on the analyzed sensor data. For example, the roadway controller 104 may transmit a control message to activate one or more roadway alert devices, such as a siren, horn, loudspeaker, or other audible device. The functionality of such activation may also be dictated by the control message. For example, in some embodiments, the control message may include an audible message to be played by a loudspeaker, may indicate the loudness and/or length of siren activation, may dictate the particular tone or frequency of horn activation, and so forth.

Additionally or alternatively, in block 822, the roadway controller 104 may control roadway signage devices based on the analyzed sensor data. For example, the roadway controller 104 may transmit a control message to one or more roadway signage devices to cause display of a message by the roadway signage device. The particular message displayed by the roadway signage may be dictated by the control message itself. For example, the roadway controller 104 may transmit a control message to a roadway signage to cause the roadway signage to display a notification of a vehicular collision or adverse road condition, as determined based on the sensor data. Regardless, after the roadway controller 104 has transmitted the control message to the one or more roadway traffic devices 106, the method 800 loops back to block 802 in which the roadway controller 104 receives additional sensor data.

Referring back to block 810, the roadway controller 104 also determines whether to control the operation of one or more roadway markers 102 based on the analyzed sensor data. If so, the method 800 advances to block 824 in which the roadway controller 104 generates and transmits an alert message to one or more roadway markers 102. As discussed above, the alert message may be configured to cause one or more roadway marker 102 to perform an alert function. The particular alert function performed by the roadway markers 102, and the operation of the alert function, may also be dictated by the alert message itself or may be predefined by the components of the roadway marker 102 as discussed above. Regardless, after the roadway controller 104 has transmitted the alert message to the one or more roadway markers 102, the method 800 loops back to block 802 in which the roadway controller 104 receives additional sensor data.

Referring back to block 812, the roadway controller 104 may also determine whether to notify one or more remote computing devices 140. As discussed above, the roadway controller 104 may determine to send a notification to a remote computing device 140 in response to a request received from the remote computing device 140. In other embodiments, the roadway controller 104 may be configured to periodically push notification to the remote computing devices 140.

If the roadway controller 104 determines that notification of one or more remote computing devices 140 is required, the method 800 advances to block 826 in which the remote computing device 140 notifies the one or more remote computing devices 140. For example, in block 828, the roadway controller 104 may transmit a notification message to one or more remote computing devices 140. As discussed above, the notification message may identify a present condition of the roadway 110, such as an environmental condition, a vehicle's presence or estimated location, and/or a roadway event such as vehicle collision. Additionally, in some embodiments, the roadway controller 104 may transmit the sensor data received in block 802 to one or more remote computing devices 104. Regardless, after the roadway controller 104 has performed any required notification in block 826, the method 800 loops back to block 802 in which the roadway controller 104 receives additional sensor data.

Figure 9:
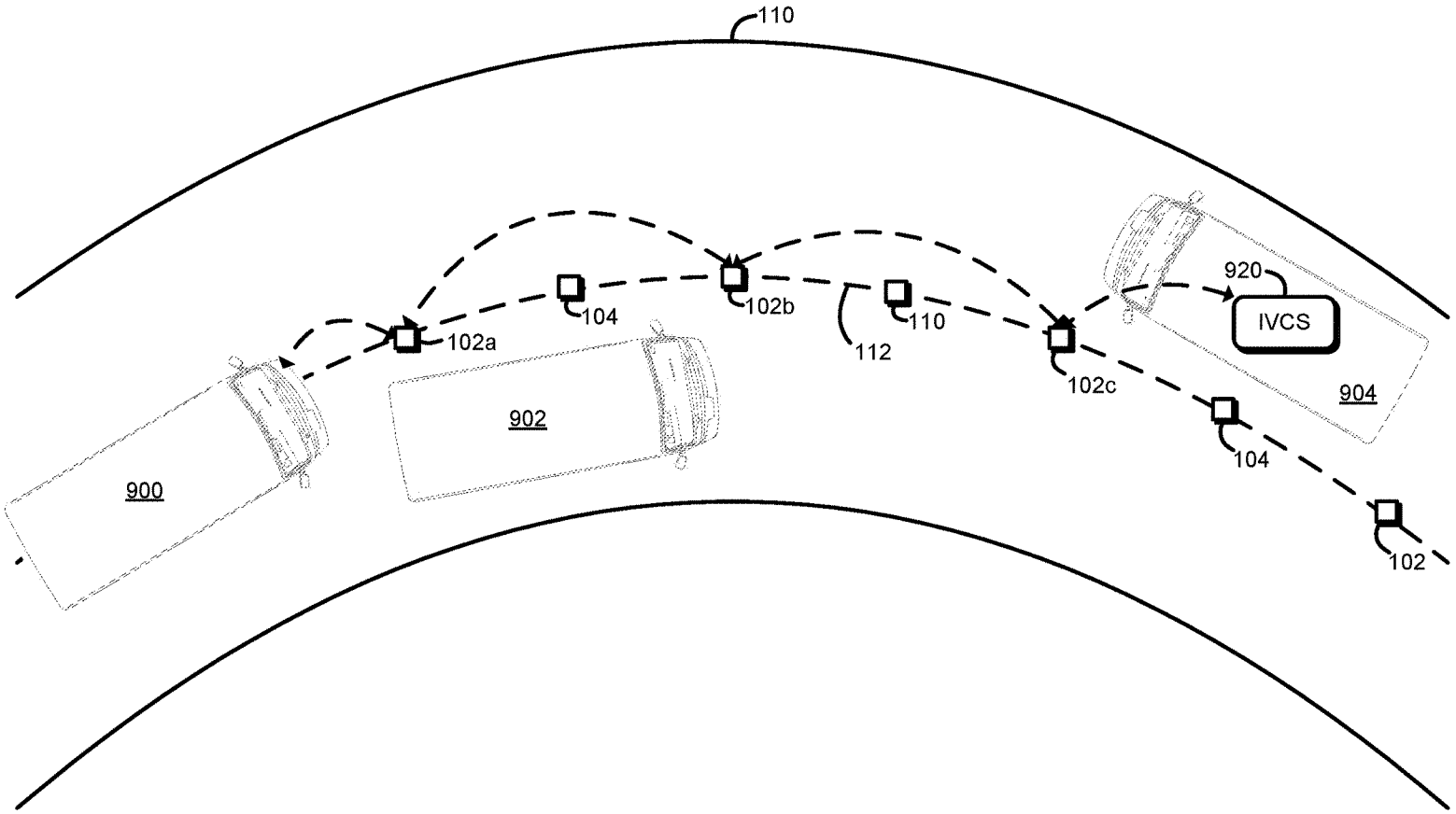
FIG. 9 is a simplified diagram of another embodiment of the system of FIG. 1 notifying a driver of an alert condition.

Referring now to FIG. 9, an illustrative embodiment of the roadway system 100 in use is illustrated. In the illustrative embodiment, a vehicle 900 is attempting to pass another vehicle 902 along a bend in the roadway 110. In response, a roadway marker 102*a* senses the presence of the vehicle 900, determines that the vehicle 900 is crossing the center divider line 112, and generates an alert message indicating that the vehicle 900 is attempting a pass or is otherwise drifting in lane. The alert message is propagated from roadway marker 102*a* to roadway marker 102*b* and from roadway marker 102*b* to roadway marker 102*c*. Roadway marker 102*c* subsequently transmits the alert message to an in-vehicle computing device 920 of a vehicle 904, which is traversing the bend of the roadway 110 in the opposite direction. In response, the in-vehicle computing device 920 may notify the driver of the vehicle 904 of the present danger, allowing the driver to take appropriate action.

In addition to providing an alert message to other vehicles, such as vehicles 902 and/or 904, the roadway system 100 may also notify the driver of the vehicle 902 of the potential danger. For example, the roadway marker 102*a* may also transmit the alert message to an in-vehicle computing system (not shown) of the vehicle 900 to warn the driver of the potential risk of his or her current action (e.g., attempting to pass, lane drifting, etc.). Additionally, as discussed above, the roadway markers 102 or a local roadway controller 104 may be configured to control local roadway traffic devices 106 (see FIG. 1) in response to the alert message. For example, one or more roadway markers 102 and/or the local roadway controller 104 may analyze the sensor data generated by the roadway markers 102 and determine that the driver of the vehicle 902 is not responding to the alert message or otherwise continuing with the dangerous activity. In response, the roadway markers 102 and/or the local roadway controller 104 may control the local roadway traffic devices 106 to reduce the danger the driver's actions. For example, the roadway markers 102 and/or the local roadway controller 104 adjust the roadway traffic lights, signage, alert devices, etc. As one particular example, the roadway markers 102 and/or the local roadway controller 104 may control local traffic lights to turn any cross-lights red to reduce the risk of a red light being run by a drunk driver to reduce the likelihood of accidents. Additionally, the local roadway controller 104 may notify a remote computing device 104 operated by authorities to inform them of the situation.

Figure 10:
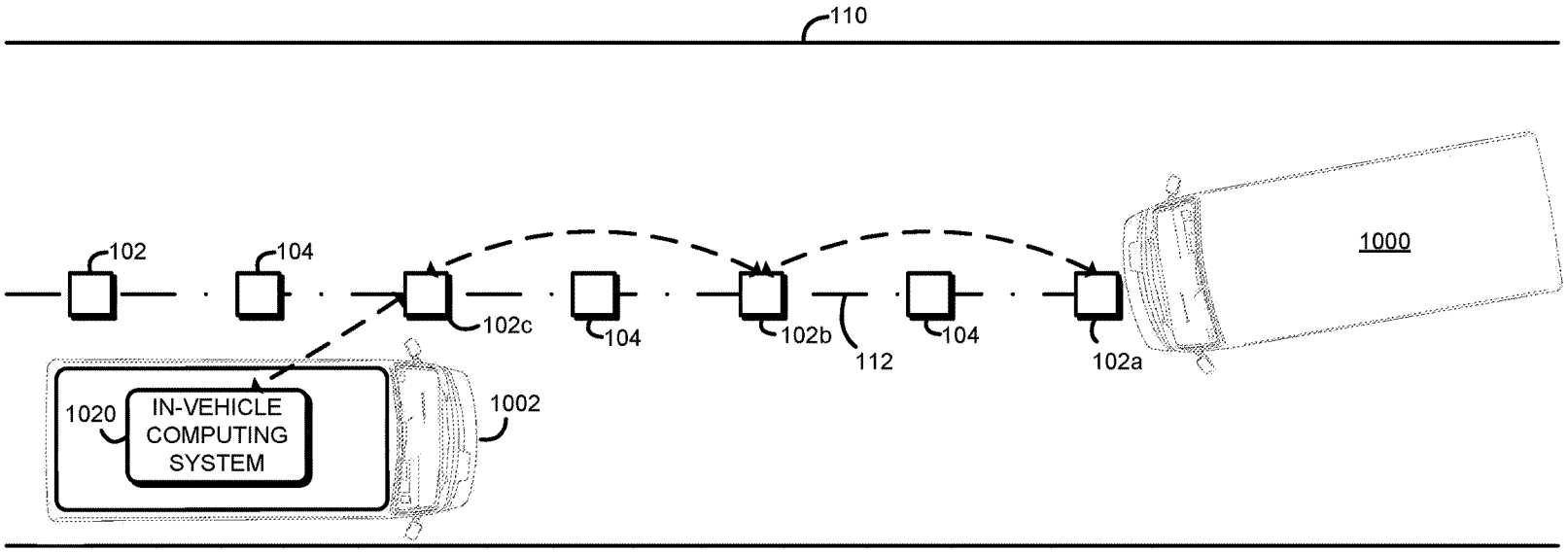
FIG. 10 is a simplified diagram of another embodiment of the system of FIG. 1 notifying a driver of an alert condition.

Referring now to FIG. 10, another illustrative embodiment of the roadway system 100 in use is illustrated. In the illustrative embodiment, a vehicle 1000 has drifted across the center divider 112. In response, a roadway marker 102*a* senses the presence of the vehicle 1000, determines that the vehicle 1000 has crossed the center divider line 112, and generates an alert message indicating that the vehicle 1000 is drifting across lanes. The alert message is propagated from roadway marker 102*a* to roadway marker 102*b* and from roadway marker 102*b* to roadway marker 102*c*. Roadway marker 102*c* subsequently transmits the alert message to an in-vehicle computing device 1020 of a vehicle 1002, which is traveling along the roadway 110 in the opposite direction. In response, the in-vehicle computing device 1020 may notify the driver of the vehicle 1002 of the present danger, allowing the driver to take appropriate action. Of course it should be appreciated that the roadway system 100 may be used to notify drivers of other roadway conditions or events such as environmental conditions, vehicle collisions, and/or the like. In the manner discussed above, the roadway markers 102 may sense such other roadway events, and propagate alert messages to alert drivers of the occurrence of the roadway event, which may improve the overall safety of drivers along the roadway 110.

EXAMPLES

Illustrative examples of the devices, systems, and methods disclosed herein are provided below. An embodiment of the devices, systems, and methods may include any one or more, and any combination of, the examples described below.

Example 1 includes a roadway marker for marking a roadway, the roadway marker comprising a communication circuit to receive a communication from a first roadway marker; and a control circuit to control the communication circuit to propagate the communication to other roadway markers, wherein to propagate the communication comprises to transmit the communication to a second roadway marker.

Example 2 includes the subject matter of Example 1, and wherein the control circuit is further to control the communication circuit to transmit the communication to an in-vehicle computing system of a vehicle on the roadway, wherein the communication comprises information indicative of a condition of the roadway.

Example 3 includes the subject matter of any of Examples 1 and 2, and wherein the control circuit is further to control the communication circuit to transmit the communication to a roadway marker controller.

Example 4 includes the subject matter of any of Examples 1-3, and wherein the communication comprises a control message, and the control circuit is further to control the communication circuit to transmit the control message to a roadway traffic device to control the operation of the roadway traffic device.

Example 5 includes the subject matter of any of Examples 1-4, and wherein the roadway traffic device comprises a roadway light and the control circuit is to control the communication circuit to transmit the control message to control the operation of the roadway light.

Example 6 includes the subject matter of any of Examples 1-5, and wherein the roadway traffic device comprises a roadway sign and the control circuit is to control the communication circuit to transmit the control message to the roadway sign to cause the sign to display a visual notification defined by the control message.

Example 7 includes the subject matter of any of Examples 1-6, and wherein the roadway traffic device comprises a roadway alert device and the control circuit is to control the communication circuit to transmit the control message to the roadway alert device to cause activation of the alert device.

Example 8 includes the subject matter of any of Examples 1-7, and wherein the alert device comprises at least one of a visual alert device or an audible alert device.

Example 9 includes the subject matter of any of Examples 1-8, and further including an alert device, wherein the control circuit is further to (i) determine whether the communication is an alert message and (ii) activate, in response to a determination that the communication is an alert message, the alert device based on the alert message.

Example 10 includes the subject matter of any of Examples 1-9, and wherein to active the alert device comprises to control operation of the alert device in a manner dictated by the alert message.

Example 11 includes the subject matter of any of Examples 1-10, and wherein the alert device comprises at least one of a visual alert device, an audible alert device, or a tactile alert device.

Example 12 includes the subject matter of any of Examples 1-11, and further including an alert device, wherein (i) the communication circuit is to receive an alert message from a roadway controller and (ii) the control circuit is further to activate, in response to receipt of the alert message from the roadway controller, the alert device based on the alert message.

Example 13 includes the subject matter of any of Examples 1-12, and wherein to activate the alert device comprises to control operation of the alert device in a manner dictated by the alert message.

Example 14 includes the subject matter of any of Examples 1-13, and wherein the alert device comprises at least one of a visual alert device, an audible alert device, or a tactile alert device.

Example 15 includes the subject matter of any of Examples 1-14, and further including a sensor to generate sensor data indicative of a road condition, wherein the control circuit is further to control the communication circuit to transmit the sensor data to the first roadway marker or the second roadway marker.

Example 16 includes the subject matter of any of Examples 1-15, and wherein the sensor comprises an environment sensor to generate sensor data indicative of a local environment of the roadway marker.

Example 17 includes the subject matter of any of Examples 1-16, and wherein the sensor comprises a vehicle presence sensor to detect the presence of a vehicle on the roadway within a proximity to the roadway marker.

Example 18 includes the subject matter of any of Examples 1-17, and wherein the control circuit is further to control the communication circuit to transmit the sensor data to an in-vehicle computing system of a vehicle on the roadway.

Example 19 includes the subject matter of any of Examples 1-18, and wherein the control circuit is further to control the communication circuit to transmit the sensor data to a roadway marker controller.

Example 20 includes the subject matter of any of Examples 1-19, and wherein the control circuit is further to (i) analyze the sensor data, (ii) determine whether an alert condition is present based on the sensor data, and (iii) perform an alert function in response to a determination that the alert condition is present.

Example 21 includes the subject matter of any of Examples 1-20, and wherein to perform the alert function comprises to activate an alert device of the roadway marker.

Example 22 includes the subject matter of any of Examples 1-21, and wherein the alert device comprises at least one of a visual alert device, an audible alert device, or a tactile alert device.

Example 23 includes the subject matter of any of Examples 1-22, and wherein to perform the alert function comprises to (i) generate an alert message based on the sensor data and (ii) control the communication circuit to transmit the alert message to the first roadway marker or the second roadway marker.

Example 24 includes the subject matter of any of Examples 1-23, and wherein to perform the alert function comprises to (i) generate an alert message based on the sensor data and (ii) control the communication circuit to transmit the alert message to an in-vehicle computing system of a vehicle on the roadway.

Example 25 includes the subject matter of any of Examples 1-24, and wherein to perform the alert function comprises to (i) generate an alert message based on the sensor data and (ii) control the communication circuit to transmit the alert message to a roadway marker controller.

Example 26 includes the subject matter of any of Examples 1-25, and wherein the communication device is further to receive an alert message from an in-vehicle computing device of a vehicle on the roadway, the alert message indicting the vehicle has been involved in a vehicular crash, and the control circuit is to control the communication circuit propagate the alert message to other roadway markers, wherein to propagate the communication comprises to transmit the alert message to the second roadway marker.

Example 27 includes the subject matter of any of Examples 1-26, and further including a rechargeable power source to supply power to the control circuit, and a power circuit to recharge the rechargeable power source.

Example 28 includes the subject matter of any of Examples 1-27, and wherein the power circuit comprises a thermoelectric power circuit.

Example 29 includes the subject matter of any of Examples 1-28, and further including (i) a housing having an upper enclosure and a bottom enclosure extending downwardly from the upper enclosure and (ii) an insulation layer attached to a bottom wall of the upper enclosure.

Example 30 includes the subject matter of any of Examples 1-29, and wherein to propagate the communication comprises to wirelessly transmit the communication to a second roadway marker.

Example 31 includes a roadway controller for controlling a roadway, the roadway controller comprising a communication module to receive sensor data from a roadway marker attached to a roadway; and a roadway management module to analyze the sensor data received from the roadway marker, generate a control message based on the sensor data, and transmit the control message to a roadway traffic device to control operation of the roadway traffic device based on the sensor data.

Example 32 includes the subject matter of Example 31, and wherein the sensor data is indicative of a condition of the roadway.

Example 33 includes the subject matter of any of Examples 31 and 32, and wherein the sensor data is indicative of a local environment of the roadway marker.

Example 34 includes the subject matter of any of Examples 31-33, and wherein the sensor data is indicative of the presence of a vehicle on the roadway.

Example 35 includes the subject matter of any of Examples 31-34, and wherein to transmit the control message to a roadway traffic device comprises to (i) determine a location of the vehicle based on the sensor data, (ii) identify a first roadway light located in front of the vehicle based on the location of the vehicle, (iii) identify a second roadway light located behind the vehicle based on the location of the vehicle, (iv) transmit a first control message to the first roadway light to cause the first roadway light to switch from an off-state to an on-state, and (v) transmit a second control message to the second roadway light to cause the second roadway light to switch from an on-state to an off-state.

Example 36 includes the subject matter of any of Examples 31-35, and wherein the roadway traffic device comprises a roadway light and the roadway management module is to transmit the control message to the roadway light to control the operation of the roadway light.

Example 37 includes the subject matter of any of Examples 31-36, and wherein the roadway traffic device comprises a roadway traffic light and the roadway management module is to transmit the control message to the roadway traffic light to control the operation of the roadway traffic light.

Example 38 includes the subject matter of any of Examples 31-37, and wherein the roadway traffic device comprises a roadway sign and the roadway management module is to transmit the control message to the roadway sign to cause the sign to display a visual notification defined by the control message.

Example 39 includes the subject matter of any of Examples 31-38, and wherein the roadway traffic device comprises a roadway alert device and the roadway management module is to transmit the control message to the roadway alert device to cause activation of the alert device.

Example 40 includes the subject matter of any of Examples 31-39, and wherein the roadway management module is further to generate an alert message based on the sensor data and transmit the alert message to the roadway marker to cause the roadway marker to generate an alert.

Example 41 includes the subject matter of any of Examples 31-40, and wherein the roadway management module is to (i) generate a notification message based on the sensor data and (ii) transmit the notification message to a remote computing device.

Example 42 includes the subject matter of any of Examples 31-41, and wherein to generate the notification message comprises to generate the notification message in response to receipt of a request for the notification message from a remote computing device.

Example 43 includes the subject matter of any of Examples 31-42, wherein the roadway management module is to transmit the sensor data to a remote computing device.

Example 44 includes a method for marking a roadway, the method comprising receiving, by a first roadway marker attached to a roadway, a communication transmitted by a second roadway marker attached to a roadway; and propagating the communication to other roadway markers by transmitting, by the first roadway marker, the communication to a third roadway marker attached to a roadway.

Example 45 includes the subject matter of Examples 44, and further including transmitting, by the first roadway marker, the communication to an in-vehicle computing system of vehicle on the roadway, wherein the communication comprises information indicative of a condition of the roadway.

Example 46 includes the subject matter of any of Examples 44 and 45, and further including transmitting, by the first roadway marker, the communication to a roadway marker controller.

Example 47 includes the subject matter of any of Examples 44-46, and wherein the communication comprises a control message and further comprising transmitting, by the first roadway marker, the control message to a roadway traffic device to control the operation of the roadway traffic device.

Example 48 includes the subject matter of any of Examples 44-47, and wherein transmitting the control message comprises transmitting the control message to a roadway light to control the operation of the roadway light.

Example 49 includes the subject matter of any of Examples 44-48, and wherein transmitting the control message comprises transmitting the control message to a roadway sign to cause the roadway sign to display a visual notification defined by the control message.

Example 50 includes the subject matter of any of Examples 44-49, and wherein transmitting the control message comprises transmitting the control message to a roadway alert device to cause the roadway alert device to display a visual notification defined by the control message.

Example 51 includes the subject matter of any of Examples 44-50, and further including determining, by the first roadway marker, whether the communication is an alert message; and activating an alert device of the first roadway marker in response to determining that the communication is an alert message.

Example 52 includes the subject matter of any of Examples 44-51, and wherein activating the alert device comprises controlling operation of the alert device in a manner dictated by the alert message.

Example 53 includes the subject matter of any of Examples 44-52, and further including generating, by a sensor of the first roadway marker, sensor data indicative of a road condition; and transmitting, by the first roadway marker, the sensor data to the second roadway marker or the third roadway marker.

Example 54 includes the subject matter of any of Examples 44-53, and wherein generating sensor data comprises generating, by an environment sensor of the first roadway marker, sensor data indicative of a local environment of the first roadway marker.

Example 55 includes the subject matter of any of Examples 44-54, and wherein generating sensor data comprises generating, by a vehicle presence sensor, sensor data indicative of the presence of a vehicle on the roadway within a proximity to the roadway marker.

Example 56 includes the subject matter of any of Examples 44-55, and further including transmitting, by the first roadway marker, the sensor data to an in-vehicle computing system of vehicle on the roadway.

Example 57 includes the subject matter of any of Examples 44-56, and further including transmitting, by the first roadway marker, the sensor data to a roadway marker controller.

Example 58 includes the subject matter of any of Examples 44-57, and further including analyzing, by the first roadway marker, the sensor data; determining, by the first roadway marker, whether an alert condition is present based on the sensor data; and performing, by the first roadway marker, an alert function in response to determining that the alert condition is present.

Example 59 includes the subject matter of any of Examples 44-58, and wherein performing the alert function comprises activating an alert device of the first roadway marker.

Example 60 includes the subject matter of any of Examples 44-59, and wherein performing the alert function comprises generating, by the first roadway marker, an alert message based on the sensor data; and transmitting, by the first roadway marker, the alert message to the second roadway marker or the third roadway marker.

Example 61 includes the subject matter of any of Examples 44-60, and wherein performing the alert function comprises generating, by the first roadway marker, an alert message based on the sensor data; and transmitting, by the first roadway marker, the alert message to an in-vehicle computing system of vehicle on the roadway.

Example 62 includes the subject matter of any of Examples 44-61, and wherein performing the alert function comprises generating, by the first roadway marker, an alert message based on the sensor data; and transmitting, by the first roadway marker, the alert message to a roadway marker controller.

Example 63 includes the subject matter of any of Examples 44-62, and further including receiving, by the first roadway marker, an alert message from an in-vehicle computing device of a vehicle on the roadway, the alert message indicting the vehicle has been involved in a vehicular crash, and propagating the alert message to other roadway markers by transmitting the alert message to the second roadway marker.

Example 64 includes the subject matter of any of Examples 44-63, and further including charging a rechargeable power source of the first roadway marker using a thermoelectric power circuit of the first roadway marker.

Example 65 includes the subject matter of any of Examples 44-64, and wherein propagating the communication comprises wirelessly transmitting, by the first roadway marker, the communication to the third roadway marker.

Example 66 includes one or more computer-readable storage media comprising a plurality of instructions that, in response to execution, cause a roadway marker to perform the method of any of Examples 44-65.

Example 67 includes a roadway marker for marking a roadway, the roadway marker comprising means for receiving a communication transmitted by a second roadway marker attached to a roadway; and means for propagating the communication to other roadway markers by transmitting the communication to a third roadway marker attached to a roadway.

Example 68 includes the subject matter of Example 67, and further including means for transmitting the communication to an in-vehicle computing system of vehicle on the roadway, wherein the communication comprises information indicative of a condition of the roadway.

Example 69 includes the subject matter of any of Examples 67 and 68, and further including means for transmitting the communication to a roadway marker controller.

Example 70 includes the subject matter of any of Examples 67-69, and wherein the communication comprises a control message and further comprising transmitting, by the first roadway marker, the control message to a roadway traffic device to control the operation of the roadway traffic device.

Example 71 includes the subject matter of any of Examples 67-70, and wherein the means for transmitting the control message comprises means for transmitting the control message to a roadway light to control the operation of the roadway light.

Example 72 includes the subject matter of any of Examples 67-71, and wherein the means for transmitting the control message comprises means for transmitting the control message to a roadway sign to cause the roadway sign to display a visual notification defined by the control message.

Example 73 includes the subject matter of any of Examples 67-72, and wherein the means for transmitting the control message comprises means for transmitting the control message to a roadway alert device to cause the roadway alert device to display a visual notification defined by the control message.

Example 74 includes the subject matter of any of Examples 67-73, and further including means for determining whether the communication is an alert message; and means for activating an alert device of the first roadway marker in response to determining that the communication is an alert message.

Example 75 includes the subject matter of any of Examples 67-74, and wherein the means for activating the alert device comprises means for controlling operation of the alert device in a manner dictated by the alert message.

Example 76 includes the subject matter of any of Examples 67-75, and further including means for generating sensor data indicative of a road condition; and means for transmitting the sensor data to the second roadway marker or the third roadway marker.

Example 77 includes the subject matter of any of Examples 67-76, and wherein the means for generating sensor data comprises means for generating sensor data indicative of a local environment of the first roadway marker.

Example 78 includes the subject matter of any of Examples 67-77, and wherein the means for generating sensor data comprises means for generating sensor data indicative of the presence of a vehicle on the roadway within a proximity to the roadway marker.

Example 79 includes the subject matter of any of Examples 67-78, and further including means for transmitting the sensor data to an in-vehicle computing system of vehicle on the roadway.

Example 80 includes the subject matter of any of Examples 67-79, and further including means for transmitting the sensor data to a roadway marker controller.

Example 81 includes the subject matter of any of Examples 67-80, and further including means for analyzing the sensor data; means for determining whether an alert condition is present based on the sensor data; and means for performing an alert function in response to determining that the alert condition is present.

Example 82 includes the subject matter of any of Examples 67-81, and wherein the means for performing the alert function comprises means for activating an alert device of the first roadway marker.

Example 83 includes the subject matter of any of Examples 67-82, and wherein the means for performing the alert function comprises means for generating an alert message based on the sensor data; and means for transmitting the alert message to the second roadway marker or the third roadway marker.

Example 84 includes the subject matter of any of Examples 67-83, and wherein the means for performing the alert function comprises means for generating an alert message based on the sensor data; and means for transmitting the alert message to an in-vehicle computing system of vehicle on the roadway.

Example 85 includes the subject matter of any of Examples 67-84, and wherein the means for performing the alert function comprises means for generating an alert message based on the sensor data; and means for transmitting the alert message to a roadway marker controller.

Example 86 includes the subject matter of any of Examples 67-85, and further including means for receiving an alert message from an in-vehicle computing device of a vehicle on the roadway, the alert message indicting the vehicle has been involved in a vehicular crash, and means for propagating the alert message to other roadway markers by transmitting the alert message to the second roadway marker.

Example 87 includes the subject matter of any of Examples 67-86, and further including means for charging a rechargeable power source of the first roadway marker using a thermoelectric power circuit of the first roadway marker.

Example 88 includes the subject matter of any of Examples 67-87, and wherein the means for propagating the communication comprises means for wirelessly transmitting, by the first roadway marker, the communication to the third roadway marker.

Example 89 includes a method for controlling a roadway by a roadway controller, the method comprising receiving, by a communication module of the roadway controller, sensor data from a roadway marker attached to a roadway; analyzing, by a roadway management module of the roadway controller, the sensor data; generating, by the roadway management module, a control message based on the sensor data; and transmitting, by a communication module of the roadway controller, the control message to a roadway traffic device of the roadway to control operation of the roadway traffic device based on the sensor data.

Example 90 includes the subject matter of Example 89, and wherein receiving sensor data comprises receiving sensor data indicative of a condition of the roadway.

Example 91 includes the subject matter of any of Examples 89 and 90, and wherein receiving sensor data comprises receiving sensor data indicative of a local environment of the roadway marker.

Example 92 includes the subject matter of any of Examples 89-91, and wherein receiving sensor data comprises receiving sensor data indicative of the presence of a vehicle on the roadway.

Example 93 includes the subject matter of any of Examples 89-92, and wherein transmitting the control message comprises determining a location of the vehicle based on the sensor data, identifying a first roadway light located in front of the vehicle based on the location of the vehicle, identifying a second roadway light located behind the vehicle based on the location of the vehicle, transmitting a first control message to the first roadway light to cause the first roadway light to switch from an off-state to an on-state, and transmitting a second control message to the second roadway light to cause the second roadway light to switch from an on-state to an off-state.

Example 94 includes the subject matter of any of Examples 89-93, and wherein transmitting the control message comprises transmitting the control message to a roadway light to control the operation of the roadway light.

Example 95 includes the subject matter of any of Examples 89-94, and wherein transmitting the control message comprises transmitting the control message to a roadway sign to cause the roadway sign to display a visual notification defined by the control message.

Example 96 includes the subject matter of any of Examples 89-95, and wherein transmitting the control message comprises transmitting the control message to a roadway alert device to cause activation of the roadway alert device.

Example 97 includes the subject matter of any of Examples 89-96, and further including generating, by the roadway management module, an alert message based on the sensor data; and transmitting the alert message to the roadway marker to cause the roadway marker to generate an alert.

Example 98 includes the subject matter of any of Examples 89-97, and further including generating, by the roadway management module, a notification message based on the sensor data; and transmitting the notification message to a remote computing device.

Example 99 includes the subject matter of any of Examples 89-98, and wherein generating the notification message comprises generating the notification message in response to receiving a request for the notification message from the remote computing device.

Example 100 includes one or more computer-readable storage media comprising a plurality of instructions that, in response to execution, cause a computing device to perform the method of any of Examples 89-99.

Example 101 includes a roadway controller for controlling a roadway, the roadway controller comprising means for receiving sensor data from a roadway marker attached to a roadway; means for analyzing the sensor data; means for generating a control message based on the sensor data; and means for transmitting the control message to a roadway traffic device of the roadway to control operation of the roadway traffic device based on the sensor data.

Example 102 includes the subject matter of Example 101, and wherein the means for receiving sensor data comprises means for receiving sensor data indicative of a condition of the roadway.

Example 103 includes the subject matter of any of Examples 101 and 102, and wherein the means for receiving sensor data comprises means for receiving sensor data indicative of a local environment of the roadway marker.

Example 104 includes the subject matter of any of Examples 101-103, and wherein the means for receiving sensor data comprises means for receiving sensor data indicative of the presence of a vehicle on the roadway.

Example 105 includes the subject matter of any of Examples 101-104, and wherein the means for transmitting the control message comprises means for determining a location of the vehicle based on the sensor data, means for identifying a first roadway light located in front of the vehicle based on the location of the vehicle, means for identifying a second roadway light located behind the vehicle based on the location of the vehicle, means for transmitting a first control message to the first roadway light to cause the first roadway light to switch from an off-state to an on-state, and means for transmitting a second control message to the second roadway light to cause the second roadway light to switch from an on-state to an off-state.

Example 106 includes the subject matter of any of Examples 101-105, and wherein the means for transmitting the control message comprises means for transmitting the control message to a roadway light to control the operation of the roadway light.

Example 107 includes the subject matter of any of Examples 101-106, and wherein the means for transmitting the control message comprises means for transmitting the control message to a roadway sign to cause the roadway sign to display a visual notification defined by the control message.

Example 108 includes the subject matter of any of Examples 101-107, and wherein the means for transmitting the control message comprises means for transmitting the control message to a roadway alert device to cause activation of the roadway alert device.

Example 109 includes the subject matter of any of Examples 101-108, and further including means for generating an alert message based on the sensor data; and means for transmitting the alert message to the roadway marker to cause the roadway marker to generate an alert.

Example 110 includes the subject matter of any of Examples 101-109, and further including means for generating a notification message based on the sensor data; and means for transmitting the notification message to a remote computing device.

Example 111 includes the subject matter of any of Examples 101-110, and wherein the means for generating the notification message comprises means for generating the notification message in response to receiving a request for the notification message from the remote computing device.

The invention claimed is:

1. A roadway marker for marking a roadway, the roadway marker comprising:

a communication circuit to receive a communication from a first roadway marker; and a control circuit to control the communication circuit to obtain sensor data indicative of the presence of a first vehicle, determine, from the obtained sensor data, whether the first vehicle has drifted out of a first lane associated with a first direction of travel to a second lane that is associated with a second direction of travel that is opposite the first direction, transmit, in response to a determination that the first vehicle has drifted out of the first lane to the second lane, the sensor data to an in-vehicle computing system of a second vehicle that is in the second lane, and propagate the communication to other roadway markers, wherein to propagate the communication comprises to transmit the communication to a second roadway marker.

2. The roadway marker of claim 1, wherein the control circuit is further to control the communication circuit to transmit the communication to a roadway marker controller.

3. The roadway marker of claim 1, wherein:

the communication comprises a control message, and the control circuit is further to control the communication circuit to transmit the control message to a roadway traffic device to control the operation of the roadway traffic device.

4. The roadway marker of claim 1, further comprising an alert device, wherein the control circuit is further to (i) determine whether the communication is an alert message and (ii) activate, in response to a determination that the communication is an alert message, the alert device based on the alert message.

5. The roadway marker of claim 1, wherein the control circuit is further to control the communication circuit to transmit the sensor data to the first roadway marker or the second roadway marker.

6. One or more computer-readable storage media comprising a plurality of instructions that cause, in response to execution, a first roadway marker to:

receive a communication transmitted by a second roadway marker attached to a roadway;

obtain sensor data indicative of the presence of a first vehicle, determine, from the obtained sensor data, whether the first vehicle has drifted out of a first lane associated with a first direction of travel to a second lane that is associated with a second direction of travel that is opposite the first direction;

transmit, in response to a determination that the first vehicle has drifted out of the first lane to the second lane, the sensor data to an in-vehicle computing system of a second vehicle that is in the second lane; and propagate the communication to other roadway markers, wherein to propagate the communication comprises to transmit the communication to a third roadway marker attached to a roadway.

7. The one or more computer-readable storage media of claim 6, wherein the plurality of instructions further cause the first roadway marker to transmit the communication to a roadway traffic device of the roadway, wherein the communication comprises a control message to control the operation of the roadway traffic device.

8. The one or more computer-readable storage media of claim 6, wherein the plurality of instructions further cause the first roadway marker to:

determine whether the communication is an alert message; and activate an alert device of the first roadway marker in response to determining that the communication is an alert message.

9. The one or more computer-readable storage media of claim 6, wherein the plurality of instructions further cause the first roadway marker to:

transmit the sensor data to the second roadway marker or the third roadway marker.

10. A method for marking a roadway, the method comprising:

receiving, by a first roadway marker attached to a roadway, a communication transmitted by a second roadway marker attached to the roadway;

obtaining, by the first roadway marker, sensor data indicative of the presence of a first vehicle, determine, from the obtained sensor data, whether the first vehicle has drifted out of a first lane associated with a first direction of travel to a second lane that is associated with a second direction of travel that is opposite the first direction;

transmitting, by the first roadway marker and in response to a determination that the first vehicle has drifted out of the first lane to the second lane, the sensor data to an in-vehicle computing system of a second vehicle that is in the second lane; and propagating the communication to other roadway markers by transmitting, by the first roadway marker, the communication to a third roadway marker attached to a roadway.

11. The method of claim 10, further comprising transmitting, by the first roadway marker, the communication to a roadway traffic device of the roadway, wherein the communication comprises a control message to control the operation of the roadway traffic device.

12. The method of claim 10, further comprising:

determining, by the first roadway marker, whether the communication is an alert message; and activating an alert device of the first roadway marker in response to determining that the communication is an alert message.

13. The method of claim 10, further comprising:

transmitting, by the first roadway marker, the sensor data to the second roadway marker or the third roadway marker.

14. A roadway controller for controlling a roadway, the roadway controller comprising:

a communication module to receive sensor data from a plurality of roadway markers attached to a roadway; and a roadway management module to analyze the received sensor data, determine whether a driver is unresponsive to an alert based on the sensor data, generate, in response to a determination that the driver is unresponsive to the alert, a control message to stop cross traffic, and transmit the control message to a roadway traffic device.

15. The roadway controller of claim 14, wherein the sensor data is indicative of (i) a condition of the roadway, (ii) a local environment of the roadway marker, or (iii) the presence of a vehicle on the roadway.

16. The roadway controller of claim 14, wherein the roadway management module is further to generate an alert message based on the sensor data and transmit the alert message to one of the roadway markers to cause the roadway marker to generate the alert.

17. The roadway controller of claim 14, wherein the roadway management module is to (i) generate a notification message based on the sensor data and (ii) transmit the notification message to a remote computing device.

18. One or more computer-readable storage media comprising a plurality of instructions that cause, in response to execution, a roadway controller to:

receive sensor data from a plurality of roadway markers attached to a roadway;

analyze the sensor data;

determine whether a driver is unresponsive to an alert based on the sensor data;

generate, in response to a determination that the driver is unresponsive to the alert, a control message to stop cross traffic; and transmit the control message to a roadway traffic device.

19. The one or more computer-readable storage media of claim 18, wherein to receive sensor data comprises to receive sensor data indicative of (i) a condition of the roadway, (ii) a local environment of the roadway marker, or (iii) a presence of a vehicle on the roadway.

20. The one or more computer-readable storage media of claim 18, wherein the plurality of instructions further cause the roadway controller to:

generate an alert message based on the sensor data; and transmit the alert message to one of the roadway markers to cause the roadway marker to generate the alert.

21. A method for controlling a roadway by a roadway controller, the method comprising:

receiving, by a communication module of the roadway controller, sensor data from a plurality of roadway markers attached to a roadway;

analyzing, by a roadway management module of the roadway controller, the sensor data;

determining, by the roadway management module of the roadway controller, whether a driver is unresponsive to an alert based on the sensor data;

generating, by the roadway management module and in response to a determination that the driver is unresponsive to the alert, a control message to stop cross traffic; and transmitting, by a communication module of the roadway controller, the control message to a roadway traffic.

22. The method of claim 19, wherein receiving sensor data comprises receiving sensor data indicative of (i) a condition of the roadway, (ii) a local environment of the roadway marker, or (iii) a presence of a vehicle on the roadway.

23. The method of claim 19, further comprising:

generating, by the roadway management module, an alert message based on the sensor data; and transmitting the alert message to one of the roadway markers to cause the roadway marker to generate the alert.

* * * * *